US008515312B2

(12) United States Patent
Yamada

(10) Patent No.: US 8,515,312 B2
(45) Date of Patent: Aug. 20, 2013

(54) FIXING DEVICE AND IMAGE FORMING APPARATUS INCLUDING SAME

(75) Inventor: Masamichi Yamada, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 208 days.

(21) Appl. No.: 13/050,457

(22) Filed: Mar. 17, 2011

(65) Prior Publication Data

US 2011/0229201 A1 Sep. 22, 2011

(30) Foreign Application Priority Data

Mar. 17, 2010 (JP) ..... 2010-061664
Mar. 10, 2011 (JP) ..... 2011-053369

(51) Int. Cl.
*G03G 15/20* (2006.01)

(52) U.S. Cl.
USPC ..... 399/122; 399/323; 399/328; 399/341

(58) Field of Classification Search
USPC ..... 399/122, 323, 320, 328, 329, 341
See application file for complete search history.

(56) References Cited

U.S. PATENT DOCUMENTS

| | | | | |
|---|---|---|---|---|
| 4,475,804 | A * | 10/1984 | Kanno et al. | 399/323 |
| 5,105,228 | A * | 4/1992 | Kato | 399/122 |
| 6,088,558 | A | 7/2000 | Yamada et al. | 399/165 |
| 6,091,926 | A | 7/2000 | Yamada | 399/329 |
| 6,351,619 | B1 | 2/2002 | Yamada | 399/70 |
| 6,553,204 | B1 | 4/2003 | Yamada | 399/328 |
| 6,577,840 | B2 | 6/2003 | Hachisuka et al. | 399/329 |
| 6,865,363 | B2 | 3/2005 | Hachisuka et al. | 399/329 |
| 6,925,280 | B2 | 8/2005 | Yamada | 399/325 |
| 7,228,096 | B2 | 6/2007 | Yamada | 399/323 |
| 7,359,664 | B2 | 4/2008 | Yamada | 399/329 |
| 7,751,768 | B2 | 7/2010 | Yamada | 399/323 |
| 7,890,039 | B2 | 2/2011 | Yamada | 399/323 |
| 2006/0008282 | A1 * | 1/2006 | Aratachi et al. | 399/328 X |
| 2006/0177249 | A1 * | 8/2006 | Aratachi et al. | 399/323 |
| 2007/0086814 | A1 * | 4/2007 | Fujiwara | 399/323 |
| 2010/0189477 | A1 | 7/2010 | Yamada | 399/329 |
| 2010/0226700 | A1 | 9/2010 | Yamada et al. | 399/329 |
| 2010/0303523 | A1 | 12/2010 | Yamada | 399/323 |
| 2011/0222874 | A1 | 9/2011 | Yamada | |
| 2011/0222881 | A1 | 9/2011 | Yamada | |

FOREIGN PATENT DOCUMENTS

| | | |
|---|---|---|
| JP | 2006-243471 | 9/2006 |
| JP | 4210486 B2 | 10/2008 |

* cited by examiner

*Primary Examiner* — Sophia S Chen
(74) *Attorney, Agent, or Firm* — Oblon, Spivak, McClelland, Maier & Neustadt, L.L.P.

(57) ABSTRACT

A fixing device for fixing a toner image on a recording medium includes a first fixing station. The first fixing station includes a fixing roller to rotate about a shaft in a predetermined direction, a pressing roller to rotate and contact the fixing roller to form a nip therebetween through which a recording medium bearing a toner image passes to fix the toner image by heat and pressure, a positioning mechanism to change the position of the pressing roller, a sheet separator disposed downstream from the nip to move in conjunction with movement of the pressing roller without changing relative positions with respect to the fixing roller, and a bracket disposed rotatable about the shaft of the fixing roller, to hold the sheet separator. A portion of the bracket contacts a portion of the positioning mechanism to be positioned in place.

8 Claims, 12 Drawing Sheets

FIXING DEVICE AND IMAGE FORMING APPARATUS INCLUDING SAME

CROSS-REFERENCE TO RELATED APPLICATIONS

The present application is based on and claims priority to Japanese Patent Application Nos. 2010-061664, filed on Mar. 17, 2010, and 2011-053369, filed on Mar. 10, 2011, both in the Japan Patent Office, which are hereby incorporated herein by reference in their entirety.

BACKGROUND OF THE INVENTION

1. Field of the Invention

Exemplary aspects of the present invention relate to a fixing device and an image forming apparatus, such as a copier, a facsimile machine, a printer, or a multi-functional system including a combination thereof, and more particularly, to a fixing device for fixing a toner image on a recording medium, and an image forming apparatus including the fixing device.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charging device uniformly charges a surface of an image carrier; an optical writer emits a light beam onto the charged surface of the image carrier to foam an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

The fixing device used in such image forming apparatuses may include a pair of looped belts or rollers, one being heated by a heater for melting toner (hereinafter referred to as "fixing member") and the other being pressed against the fixing member (hereinafter referred to as "pressing member"). In a fixing process, the fixing member and the pressing member meet and press against each other, forming a so-called a fixing nip through which a recording medium is passed to fix a toner image thereon under heat and pressure.

Toner used in such fixing devices generally contains resin material. When melted in the nip portion, the toner in the toner image on the recording medium tends to stick to the fixing member, winding around the fixing member even after the recording medium exits the nip portion, causing a paper jam. To address such difficulty, a wax component is added to the toner, or alternatively, the fixing member is covered with a release agent such as silicon oil, to prevent the toner in the toner image sticking to the fixing member.

In recent years, however, because of difficulty in handling of the release agent such as the silicon oil, application of such a release agent on the fixing member becomes less frequent, complicating efforts to separate reliably the recording medium bearing the toner image from the fixing member.

To counteract such a difficulty, to facilitate separation of the recording medium bearing the melted toner from the fixing member, a separation mechanism including a separation claw is proposed to separate physically the recording medium undesirably wound around the fixing member from the fixing member. Disadvantageously, such a separation claw slidably contacts the fixing member while rotating, leaving a trace of slide on the surface of the fixing member, thereby yielding a resulting image with streaks. Furthermore, because the position of the separation claw is fixed, the distance between the tip of the separation claw and an end of the nip portion changes as the pressing member moves to accommodate different types and thicknesses of the recording media sheets, thus hindering reliable separation of the recording medium from the fixing member.

In view of the above, a contactless separation plate disposed very close to the fixing member is proposed. In order to obtain a similar reliable separation ability as the separation claw that directly contacts the fixing member, the space between the contactless separation plate and the fixing member needs to be minute and adjusted by 0.1 mm, for example. Furthermore, the separation plate needs to be disposed as close to the nip exit as possible.

In a related-art belt-type fixing device, such a contactless separation plate is disposed close to the nip exit downstream in a direction of conveyance of the recording medium. The separation plate does not move in accordance with changes in the position of the fixing belt. Since the separation plate does not move in conjunction with the movement of the fixing member, the distance between the nip exit and the tip of the separation plate varies as the fixing member moves. That is, the relative positions of the separation plate and the fixing member change as the fixing member moves, complicating efforts to adjust accurately the slight gap between the tip of the separation plate and the fixing member. Similarly, as the pressing member moves in accordance with the types and thickness of the recording medium, the gap between the nip exit and the tip of the separation plate also varies, thereby also hindering separation of the recording medium.

Another example of separation of the recording medium after exiting the nip portion includes a peeling pad disposed inside an inner loop formed by the belt-type fixing member after the end of the nip, to change a curvature of the looped fixing member after the nip exit. In this configuration, a change in the curvature of the fixing member after the nip portion bends a conveyance path of the recording medium, thereby facilitating separation of the recording medium as it exits the nip portion. However, similar to the foregoing configuration, the peeling pad does not move in conjunction with the pressing member that moves in accordance with types and thickness of the recording medium. Therefore, the relative positions of the peeling pad and the pressing member change, thereby changing undesirably the gap between the peeling pad and the nip exit, and thus hindering reliable separation of the recording medium from the fixing member.

Even if both the peeling pad and the contact-less separation member such as the separation plate are employed in a fixing device, the relative positions of the peeling pad and the separation member relative to the nip exit change when the position of the pressing member moves.

BRIEF SUMMARY OF THE INVENTION

In view of the foregoing, in one illustrative embodiment of the present invention, a fixing device for fixing a toner image on a recording medium includes a first fixing station. The first fixing station includes a fixing roller, a pressing roller, a positioning mechanism, a sheet separator, and a bracket. The fixing roller rotates about a shaft in a predetermined direction of rotation. The pressing roller is disposed opposite the fixing roller, to rotate and contact an outer circumferential surface of the fixing roller to form a nip between the pressing roller and the fixing roller through which the recording medium bearing the toner image passes to fix the toner image with heat and pressure. The position of the pressing roller is changeable relative to the fixing roller. The positioning mechanism is operatively connected to the pressing roller to change the position of the pressing roller. The sheet separator is disposed downstream from the nip to move in conjunction with movement of the pressing roller to separate the recording medium from the fixing roller without changing the position relative to the fixing roller. The bracket is disposed rotatable about the shaft of the fixing roller, to hold the sheet separator. A portion of the bracket contacts a portion of the positioning mechanism to be positioned in place.

In another illustrative embodiment of the present invention, an image forming apparatus includes the fixing device.

Additional features and advantages of the present invention will be more fully apparent from the following detailed description of illustrative embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of illustrative embodiments when considered in connection with the accompanying drawings, wherein.

DETAILED DESCRIPTION OF THE INVENTION

Figure 1:
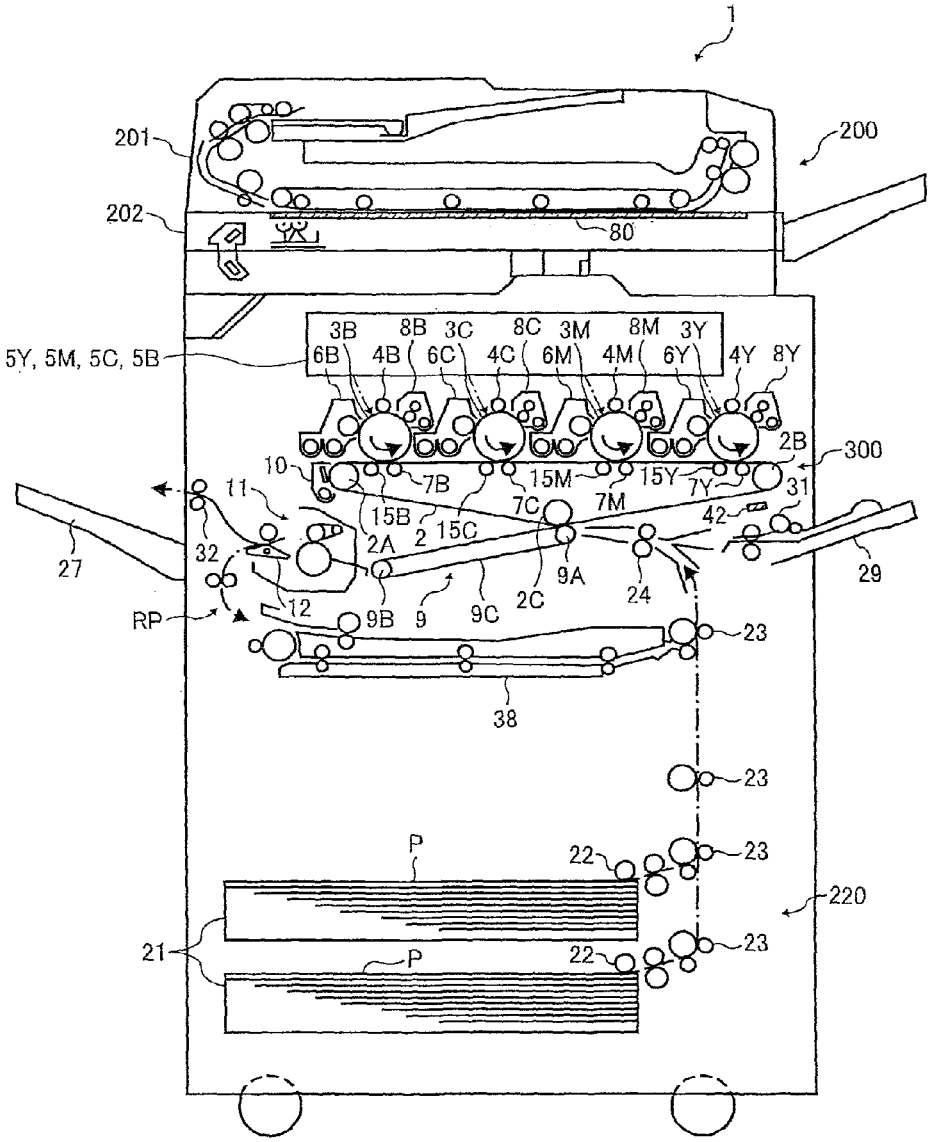
FIG. 1 is a schematic diagram illustrating an image forming apparatus according to an exemplary embodiment of the present invention.

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but includes other printable media as well.

Referring now to the drawings, wherein like reference numerals designate identical or corresponding parts throughout the several views, in particular to FIG. 1, a tandem-type image forming apparatus according to an exemplary embodiment of the present invention is explained.

Referring to FIG. 1, there is provided a schematic diagram illustrating a color copier as an example of the image forming apparatus.

As illustrated in FIG. 1, an image forming apparatus 1 includes an image forming unit 300, a sheet feeding unit 20 substantially below the image forming unit 300, and an image reader 200 substantially above the image forming unit 300. The image forming unit 300 includes an intermediate transfer belt 2 having a transfer surface extending horizontally on which a toner image is transferred, and photoconductive drums 3Y, 3M, 3C, and 3B serving as image carriers arranged in tandem along the intermediate transfer belt 2 facing the transfer surface of the intermediate transfer belt 2. It is to be noted that reference characters Y, M, C, and B denote the colors yellow, magenta, cyan, and black, respectively. To simplify the description, the reference characters Y, M, C, and B indicating colors are omitted herein unless otherwise specified.

The photoconductive drums 3Y, 3M, 3C, and 3B rotate in a counterclockwise direction. Around each of the photoconductive drums 3Y, 3M, 3C, and 3B, a charging device 4, an optical writer 5, a developing device 6, a transfer bias roller 7, a voltage applicator 15, a cleaning device 8 are disposed. The charging device 4 charges the respective photoconductive drum 3 while the photoconductive drum 3 is rotated. The optical writer 5 serves as an exposure device to form an electrostatic latent image on the respective photoconductive drum 3 based on image information read by the image reader 200. The developing device 6 develops the electrostatic latent image formed on the photoconductive drum 3 with toner having the same polarity as that of the electrostatic latent image. The transfer bias roller 7 serves as a primary transfer member. In each of the developing devices 6, the respective color of toner is stored.

The intermediate transfer belt 2 is rotatably wound around and stretched between a plurality of rollers 2A, 2B, and 2C disposed in the inner loop of the intermediate transfer belt 2. The intermediate transfer belt 2 rotates in the same direction as that of the photoconductive drums 3Y, 3M, 3C, and 3B at the position facing each other. The rollers 2A and 2B support the transfer surface of the intermediate transfer belt 2. The roller 2C is disposed facing a secondary transfer unit 9 through the intermediate transfer belt 2. The image forming apparatus also includes a belt cleaning unit 10.

The photoconductive drums 3Y, 3M, 3C, and 3B all have the same configuration as all the others, differing only in the color of toner employed. Thus, a description is provided of the photoconductive drum 3Y as a representative example of the photoconductive drums. The surface of the photoconductive drum 3Y is charged uniformly by the charging device 4Y. An electrostatic latent image is formed on the photoconductive drum 3Y based on the image information read by the image reader 200.

The electrostatic latent image formed on the photoconductive drum 3Y is developed with yellow toner by the developing device 6Y to form a visible image, also known as a toner image. The developing device 6Y stores a two-component developing agent consisting of carrier and toner. Subsequently, the toner image is primarily transferred from the photoconductive drum 3Y onto the intermediate transfer belt 2 due to an electric field created by the voltage applied to the transfer bias roller 7Y.

The voltage applicator 15Y is disposed upstream from the transfer bias roller 7Y in the direction of rotation of the photoconductive drum 3Y. The voltage applicator 15Y applies a voltage same as the polarity of the photoconductive drum 3Y and an absolute value greater than when printing a solid image, to the intermediate transfer belt 2, thereby preventing toner from getting transferred undesirably from the photoconductive drum 3Y to the intermediate transfer belt 2 before the toner image enters a transfer area and thus preventing degradation of imaging quality.

Similarly, image forming operation similar to the photoconductive drum 3Y is performed with regards to the photoconductive drums 3M, 3C, and 3B, and toner images of the respective color are overlappingly transferred onto the intermediate transfer belt 2, forming a composite color toner image.

After the transfer process, toner (residual toner) remaining on the photoconductive drums 3 is removed therefrom by the cleaning device 8. In the meantime, the potential of the photoconductive drums 3 is initialized by a charge eraser after the transfer process in preparation for the subsequent imaging cycle.

The secondary transfer unit 9 includes a transfer belt 9C wound around and stretched between a drive roller 9A serving as a charger and a driven roller 9B. The transfer belt 9C moves in the same direction as that of the intermediate transfer belt 2. The drive roller 9A charges the transfer belt 9C to transfer the composite toner image formed on the intermediate transfer belt 2 onto a recording medium P.

Multiple recording media sheets P are stored in sheet cassettes 21 of the sheet feed unit 220 and fed to a secondary transfer position. An uppermost recording medium P in one of the sheet cassettes 21 is picked up by a pickup roller 22 and conveyed to sheet feed roller pairs 23 which guide the recording medium P to a registration roller pair 24 which is disposed upstream from the secondary transfer position.

The recording medium P fed from the sheet cassette 22 is temporarily stopped at the registration roller pair 24 at which the position of the recording medium P is aligned. Subsequently, the recording medium P is sent to the secondary transfer position in appropriate timing such that the recording medium P is aligned with the toner image on the intermediate transfer belt 2.

A manual feed tray 29 is foldably disposed at the right side of the image forming apparatus 1. When manually fed, the recording medium P placed on the manual feed tray 29 is conveyed to the registration roller pair 24 by a sheet feed roller 31 through the same sheet conveyance path through which the recording medium P conveyed from the sheet cassette 21 also passes.

The optical writers 5Y, 5M, 5C, and 5B illuminate the respective photoconductive drums 3Y, 3M, 3C, and 3B with light based on image information received from the image reader 200 or a computer, thereby forming electrostatic latent images on the photoconductive drums 3Y, 3M, 3C, and 3B.

The image reader 200 includes an automatic document feeder 201 and a scanner 202 which includes a contact glass 80 on which a recording medium P is placed. The automatic document feeder 201 can reverse a document to be conveyed to the contact glass 80 so that both sides of the document are scanned.

The electrostatic latent images formed on the photoconductive drums 3 by the respective optical writers 5 are developed with respective color of toner by the developing devices 6, thereby forming a visible image, also known as a toner image, on the photoconductive drums 3. Subsequently, the toner images are overlappingly and primarily transferred onto the intermediate transfer belt 2, forming a composite toner image. Then, the secondary transfer unit 9 secondarily transfers the composite toner image onto the recording medium P. The recording medium P bearing the toner image is sent to a fixing device 11 in which the toner image, also called an unfixed image, is fixed onto the recording medium P by heat and pressure.

The residual toner remaining on the intermediate transfer belt 2 after the secondary transfer process is cleaned by the belt cleaning device 10.

The recording medium P passed through the fixing device 11 is guided to either a conveyance path leading to a catch tray 27 or a reverse path RP by a switching claw 12. In a case in which the recording medium P is conveyed to the catch tray 27, the recording medium P is discharged to and stacked on the catch tray 27 by a pair of discharge rollers 32. By contrast, in a case in which the recording medium P is conveyed to the reverse path RP, the recording medium P is turned by a sheet reverse unit 38 and is sent to the registration roller pair 24.

When forming a single-color image, a single-color toner image is transferred on the intermediate transfer belt 2 and then transferred onto the recording medium P fed from the sheet cassette 21. By contrast, when forming a multi-color toner image, toner images of different colors are overlappingly transferred onto the intermediate transfer belt 2 and then transferred secondarily onto the recording medium P. After the secondary transfer process, the unfixed toner image is fixed by the fixing device 11 and discharged onto the catch tray 27, or is reversed for forming an image on the other side of the recording medium P.

It is to be noted that a reference number 42 refers to a density detector to detect a density of the toner pattern.

Figure 2:
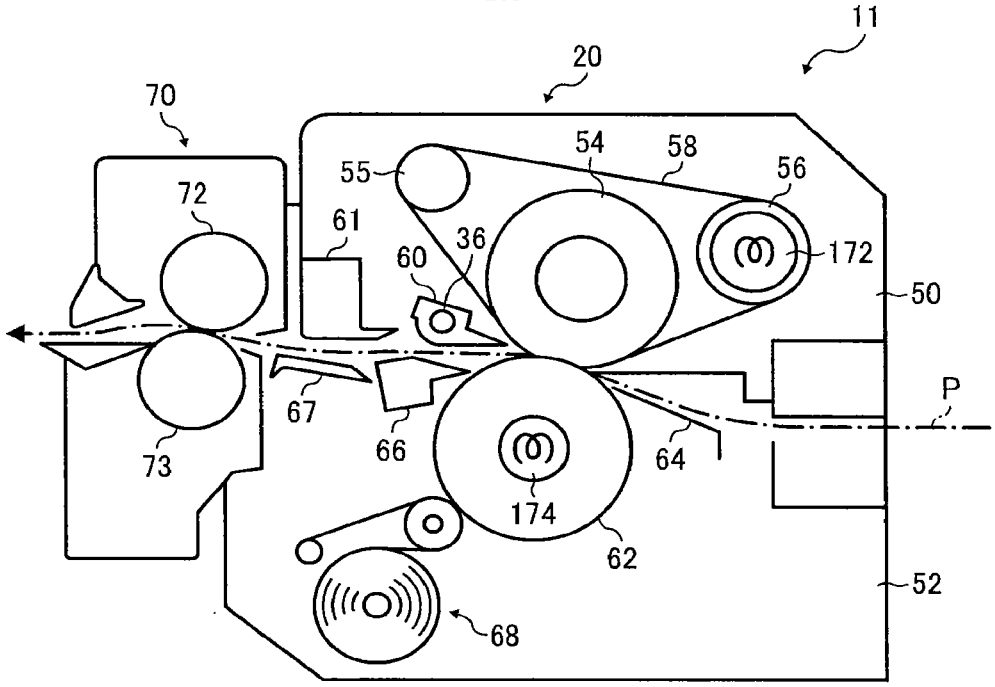
FIG. 2 is a schematic diagram illustrating a fixing device according to an illustrative embodiment of the present invention, employed in the image forming apparatus shown in FIG. 1.

With reference to FIGS. 1 and 2, a description is provided of the fixing device 11 according to the illustrative embodiment of the present invention. FIG. 2 is a schematic diagram illustrating the fixing device 11, according to the illustrative embodiment of the present invention.

As illustrated in FIG. 2, the fixing device 11 includes a first fixing station 20 and a second fixing station 70. The second fixing station 70 is disposed downstream from the first fixing station in the direction of the conveyance of the recording medium P, to apply gloss finish on the fixed image on the recording medium P.

The first fixing station 20 includes an upper unit 50 and a lower unit 52. The upper unit 50 includes a first sheet separator 60 serving as a sheet separator for separating the recording medium from a fixing roller 54, a first sheet guide 61, the fixing roller 54, a heating roller 56, a support roller 55, and a fixing belt 58 wound around and stretched between the fixing roller 54, the heating roller 56, and the support roller 55.

The lower unit 52 includes a pressing roller 62, a nip guide 64, a second sheet separator 66 serving as a sheet separator for separating a recording medium from the pressing roller 62, a second sheet guide 67 disposed downstream from the second sheet separator 66, a cleaning device 68 which cleans the surface of the pressing roller 62, and so forth. The cleaning device 68 is a belt-like cleaning member (a web) that cleans the surface of the pressing roller 62.

The first sheet separator 60, the first sheet guide 61, the second sheet separator 66, and the second sheet guide 67 have a length similar to, if not the same as, a shaft of the pressing roller 62, extending in an axial direction of the fixing roller 54 and the pressing roller 62.

The pressing roller 62 is pressed against the fixing roller 54 through the fixing belt 58, thereby forming a nip between the pressing roller 62 and the fixing belt 58 through which a recording medium P is conveyed. A halogen heater 172 serving as a heat source is disposed in the heating roller 56. A halogen heater 174 is disposed in the pressing roller 62. The halogen heater 172 includes multiple heaters. An amount of heat of the halogen heater 172 is adjusted by selecting a number of power distribution wires as necessary.

The recording medium P bearing an unfixed toner image is conveyed to the nip portion from the right side in FIG. 2. In the nip portion, heat and pressure are applied to the recording medium, thereby fixing the unfixed toner image on the recording medium.

The fixing belt 58 includes a base layer formed of polyimide resin having an internal diameter of approximately 105 mm and a thickness of approximately 90 μm. A silicon rubber layer having a thickness of approximately 200 μm is provided on the base layer. The silicon rubber layer is coated with tetrafluoroethylene-perfluoroalkylvinylether copolymer (hereinafter PFA) having a thickness of approximately 20 μm as an outermost surface.

The fixing roller 54 includes a heat-resistant elastic layer formed of, for example, silicon rubber having an outer diameter of approximately 65 mm and a thickness of approximately 14 mm.

The heating roller 56 is constructed of a metal hollow tube, for example, an aluminum tube, having an outer diameter of approximately 40 mm and a thickness of approximately 0.6 mm.

The pressing roller 62 is constructed of a metal hollow core including metal material such as copper having a thickness of approximately 1 mm and an outer diameter approximately 65 mm. On the metal core, a silicon rubber layer having a thickness of approximately 1.5 mm is provided. On the silicon rubber layer, a tube made of PFA is provided as an outermost surface.

After the toner image on the recording medium P is fixed in the first fixing station 20, the recording medium P is conveyed to the second fixing station 70 by the first sheet guide 61 and the second sheet guide 67.

The second fixing station 70 includes a second fixing roller 72 and a second pressing roller 73. In the second fixing station 70, the recording medium bearing the toner image, which has been fixed in the first fixing station 20, is sandwiched and heated by the second fixing roller 72 and the second pressing roller 73, thereby applying gloss finish thereon. In the second fixing station 70, the toner image is heated in a desired nip width with a desired temperature, to produce a gloss image desired by a user. If no gloss image is requested by a user, the recording medium P passes through the second fixing station 70 while the second fixing roller 72 and the second pressure roller 73 are separated. Subsequently, the recording medium P is discharged outside.

Figure 3:
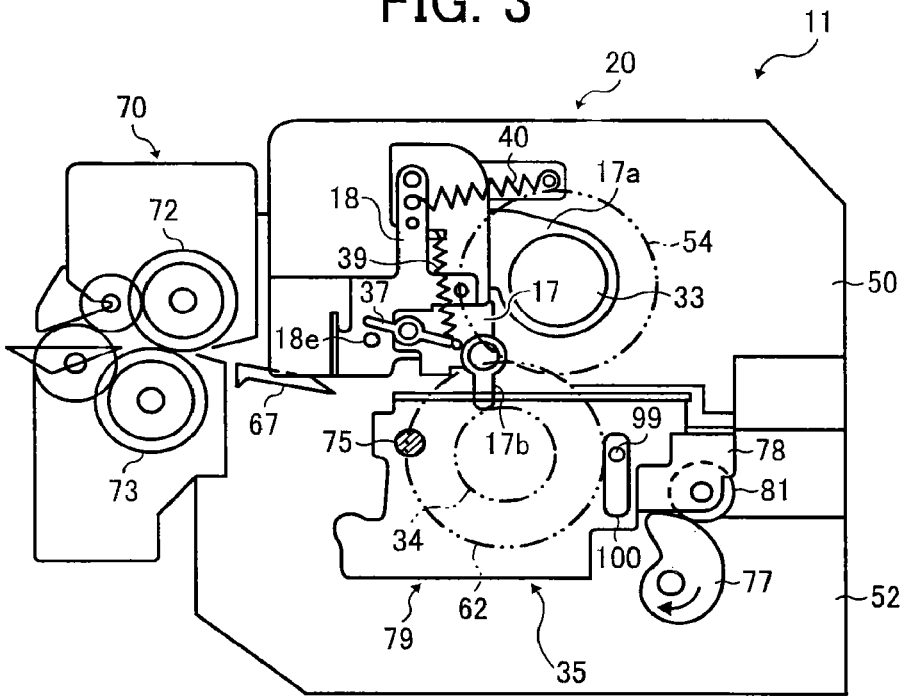
FIG. 3 is a schematic diagram illustrating a positioning mechanism, a bracket, and a sub-bracket, employed in the fixing device of FIG. 2 according to an illustrative embodiment of the present invention.

FIG. 3 is a schematic diagram illustrating a bracket 17 and a sub-bracket 18 included in the upper unit 50 and employed in the fixing device 11 according to the illustrative embodiment. The bracket 17 is disposed rotatable about the axis of rotation of the fixing roller 54. The sub-bracket 18 is rotatably provided to the bracket 17 and holds the first sheet separator 60.

The pressing roller 62 is held by a pressing lever assembly 35 serving as a positioning mechanism that is hinged along a shaft 75. The pressing lever assembly 35 includes at least an internal lever 78, an external lever 79, and a ball bearing 34, and is driven by a cam 77, thereby enabling adjustment of the position of the pressing roller 62 relative to the fixing roller 54 at different positions in accordance with a type and a thickness of the recording medium P.

It is to be noted that, as used in this specification, the term "pressure-free state" refers to either the pressing roller 62 being separated from the fixing belt 58 or the pressing roller 62 contacting the fixing belt 58 without pressure.

The cam 77 is rotated by a drive source. When the cam 77 is rotated in a clockwise direction, the pressing lever assembly 35 can rotate upward so that the pressing roller 62 contacts the fixing roller 54 with pressure. By contrast, when the cam 77 is rotated in an opposite direction (counterclockwise), the pressing roller 62 moves from its pressing position to the pressure-free position.

The pressing lever assembly 35 serving as the positioning mechanism is constituted of the internal lever 78, which is directly moved by the cam 77, and the external lever 79 holding the pressing roller 62. Both the internal lever 78 and the external lever 79 rotate about the shaft 75. The rotation mechanism for rotating the pressing lever assembly 35 using the cam 77 is provided at both lateral end portions of the pressing roller 62 in the axial direction thereof.

Figure 4A:
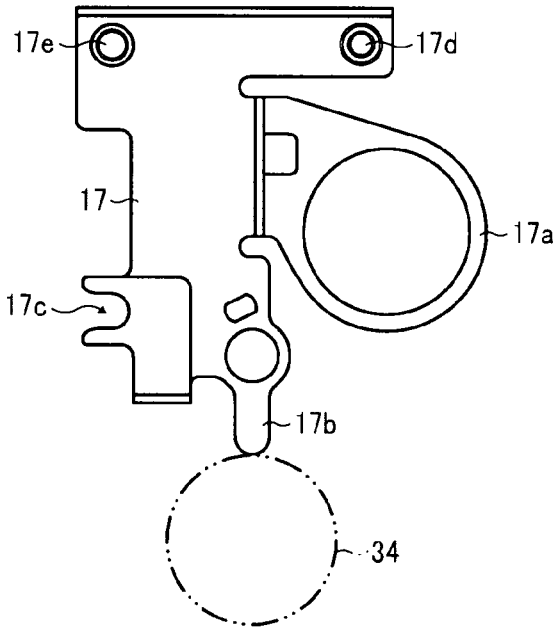
FIG. 4A is a front view of the bracket according to an illustrative embodiment of the present invention.
Figure 4B:
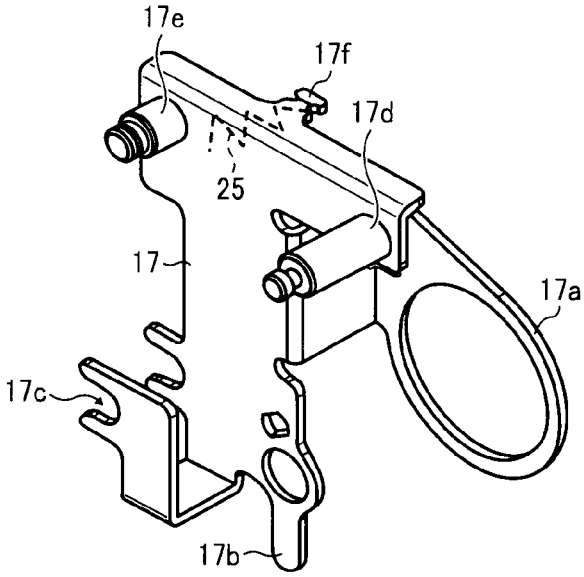
FIG. 4B is a schematic perspective view of the bracket of FIG. 4A.

Referring now to FIGS. 4A and 4B, a description is provided of the bracket 17 according to the illustrative embodiment of the present invention. FIG. 4A is a front view of the bracket 17. FIG. 4B is a perspective view of the bracket 17.

As illustrated in FIG. 4A, the bracket 17 includes a fitting portion 17*a*, a contact portion 17*b*, a groove 17*c*, a spring stopping shaft 17*d*, a support shaft 17*e*, and a spring stopper 17*f*. The fitting portion 17*a* includes a hole into which a ball bearing 33 (shown in FIG. 3) fits. The ball bearing 33 supports the rotary shaft of the fixing roller 54. The contact portion 17*b* contacts an outer circumferential surface of the ball bearing 34 which supports the rotary shaft of the pressing roller 62. As will be later described, a rotary shaft of the first sheet separator 60 fits the groove 17*c*. The support shaft 17*e* rotatably supports the sub-bracket 18. The spring stopper 17*f* is formed substantially at an upper end portion of the bracket 17. Between the spring stopper 17*f* and the fixing device main body, a spring 25 is disposed to rotate the bracket 17 downward about the shaft of the fixing roller 54, that is, toward the pressing roller side, thereby biasing the contact portion 17*b* against the outer circumferential surface of the ball bearing 34.

Figure 5A:
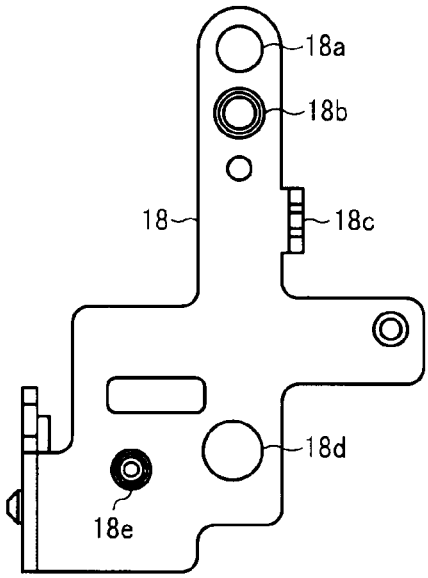
FIG. 5A is a front view of the sub-bracket.
Figure 5B:
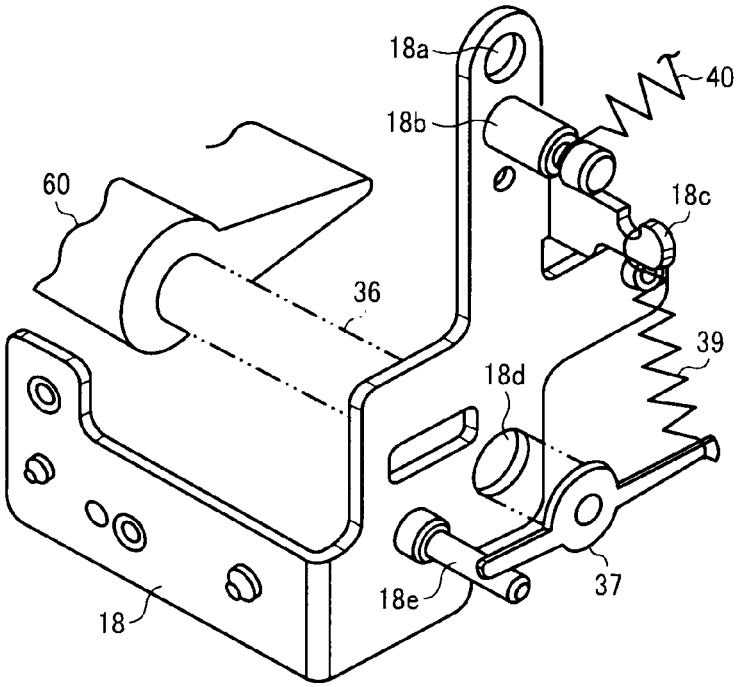
FIG. 5B is a schematic perspective view of the sub-bracket of FIG. 5A according to an illustrative embodiment of the present invention.

Referring now to FIGS. 5A and 5B, a description is provided of the sub-bracket 18 according to the illustrative embodiment. FIG. 5A is a front view of the sub-bracket 18. FIG. 5B is a schematic perspective view of the sub-bracket 18.

As illustrated in FIG. 5A, the sub-bracket 18 includes a through-hole 18*a* through which the support shaft 17*e* of the bracket 17 is inserted, a spring stopping shaft 18*b* below the through-hole 18*a*, a hook 18*c* located at the tip of the shaft 18*b*, a support hole 18*d* well below the hook 18*c*, and a regulation pin 18*e* located to one side of the hole 18*d*. As will be later described, a spring 39 is latched at the hook 18*c*. The support hole 18*d* supports a rotary shaft 36 of the first sheet separator 60, and thus has a diameter sufficient to accommodate the rotary shaft 36.

As illustrated in FIG. 5B, a lever 37 is fixed to a shaft 36 passing through the hole 18*d*. The spring 39 is disposed between one end of the lever 37 and the hook 18*c*. The spring 39 biases the first sheet separator 60 towards the fixing roller 54. As will be later described, the first sheet separator 60 is biased by the spring 39 against the fixing roller 54 outside a recording medium passing area of the fixing roller 54, that is, a portion of the fixing roller 54 over which the recording medium passes.

The regulation pin 18*e* regulates the number of rotations of the lever 37 when the first sheet separator 60 is separated from fixing roller 54. A spring 40 (shown in FIG. 3) is disposed between the spring stopping shaft 17*d* of the bracket 17 and the spring stopping shaft 18*b* of the sub-bracket 18, thereby biasing rotatably the sub-bracket 18 about the support shaft 17*e* towards the fixing roller 54.

As will be later described, in the event of a paper jam, the first sheet separator 60 is opened by rotating the sub-bracket 18. In such a configuration, if the first sheet separator 60 is positioned in place by the sub-bracket 18, the sheet separator such as the first sheet separator 60 may not be positioned accurately relative to the fixing roller 54, thereby hindering separation of the recording medium from the fixing roller 54.

To counteract such difficulty, according to the present illustrative embodiment, when assembling the sub-bracket 18 and the bracket 17, the rotary shaft 36 of the first sheet separator 60 fits the groove 17*c* of the bracket 17 that rotates about the rotary shaft of the fixing roller 54, thereby positioning the first sheet separator 60 in place. Accordingly, the relative positions of the fixing roller 54 and the first sheet separator 60 are determined by using one part, that is, the bracket 17, thereby ensuring positioning accuracy. With this configuration, the separability of the sheet separator, the first sheet separator 60, does not degrade even when the sheet separator is opened and closed.

Figure 6:
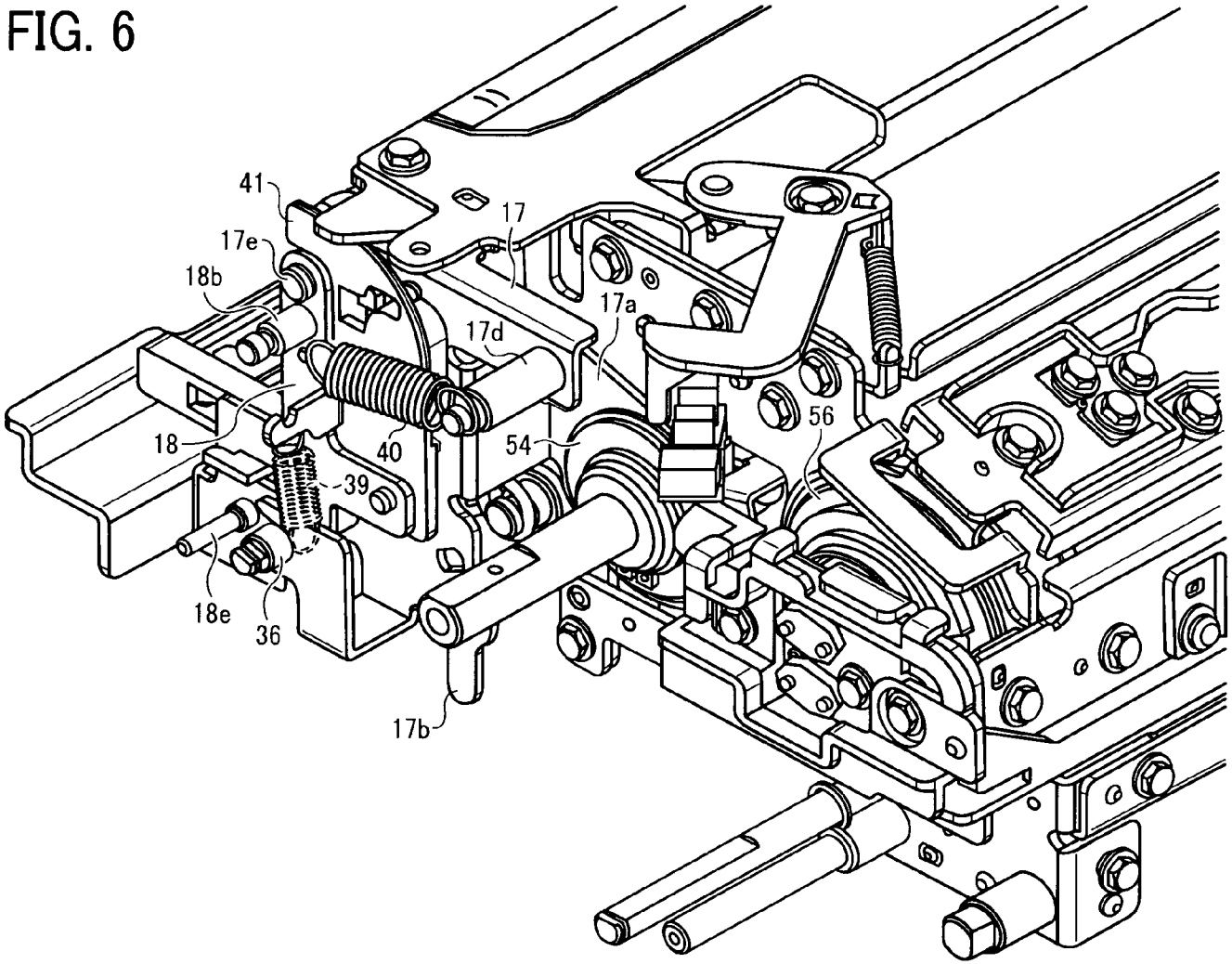
FIG. 6 is a schematic perspective diagram partially illustrating an assembly of the bracket and the sub-bracket at one end portion of the fixing roller in an axial direction thereof.

With reference to FIG. 6, a description is provided of assembly of the bracket 17 and the sub-bracket 18. FIG. 6 is a schematic perspective view, partially illustrating assembly of the bracket 17 and the sub-bracket 18 at one end portion of the fixing roller 54 in the axial direction thereof. The other end of the fixing roller 54 has the same configuration.

The sub-bracket 18 is disposed substantially outside the bracket 17 through a plate 41. In FIG. 6, one end portion of each of the springs 39 and 40 is not latched.

Figure 7:
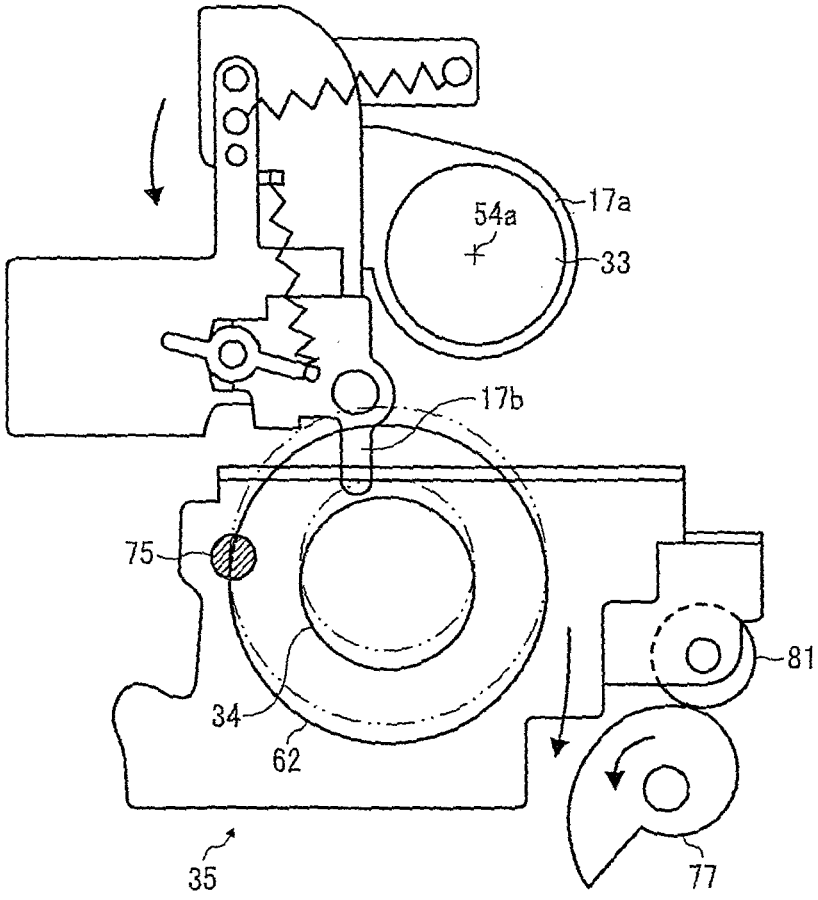
FIG. 7 is a schematic diagram illustrating movement of the bracket and the sub-bracket in conjunction with movement of the pressing roller.

FIG. 7 is a schematic diagram illustrating the movement of the bracket 17 and the sub-bracket 18 in conjunction with the movement of the pressing roller 62. As illustrated in FIG. 7, as the cam 77 rotates in the counterclockwise direction to separate the pressing roller 62 from the fixing roller 54, the spring force of the spring 25 causes the bracket 17 and the sub-bracket 18 to rotate downward about an axial center 54*a* of the fixing roller 54. Subsequently, the contact portion 17*b* of the bracket 17 moves while contacting the outer circumferential surface of the ball bearing 34 supporting the pressing roller 62. In other words, the bracket 17 and the sub-bracket 18 move in conjunction with the movement of the pressing roller 62. With this configuration, the first sheet separator 60 held by the bracket 17 through the sub-bracket 18 rotatably moves about the axial center 54*a* of the fixing roller 54 towards the nip exit.

Figure 8A:
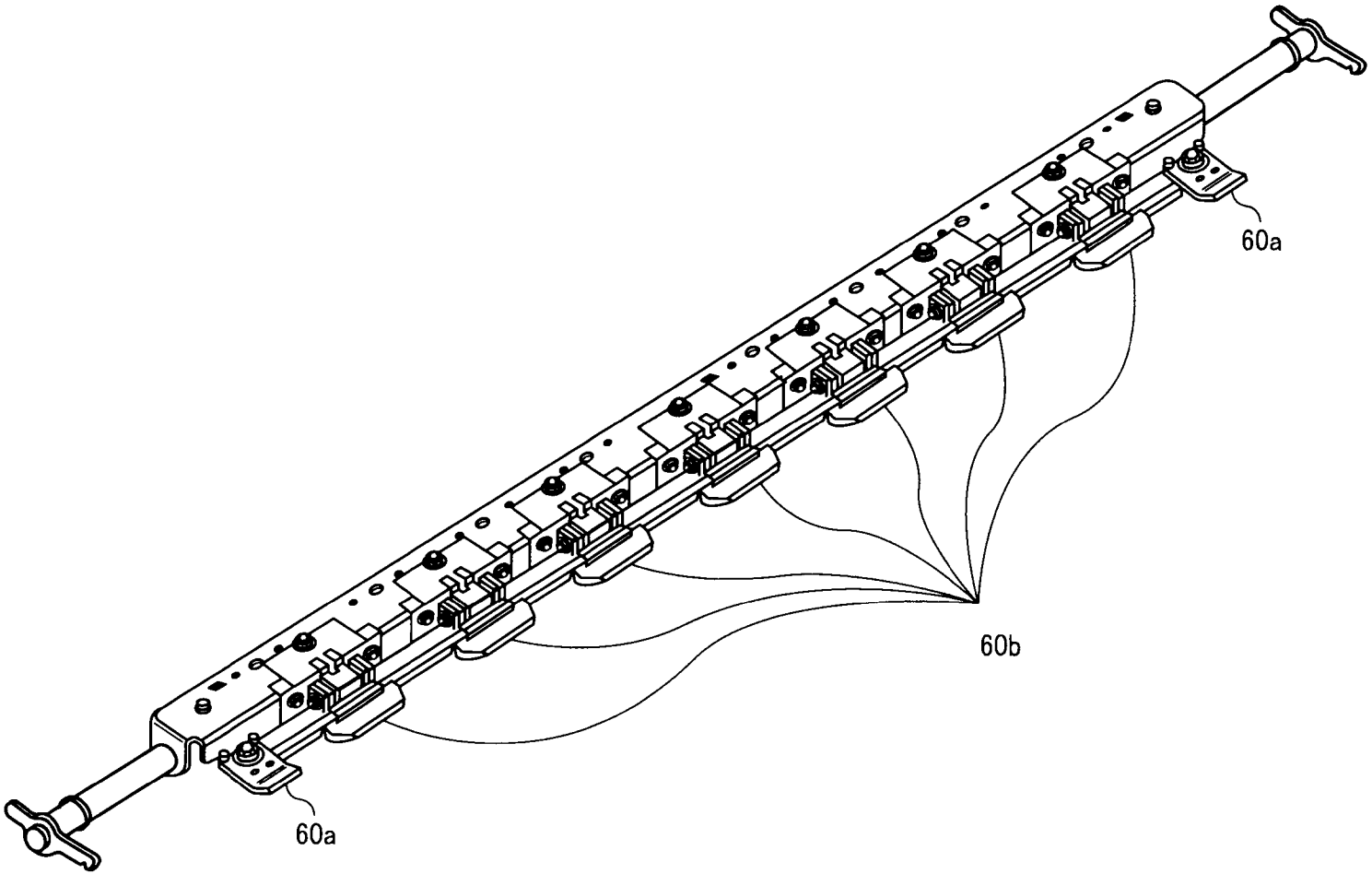
FIG. 8A is a schematic diagram illustrating a first sheet separator according to an illustrative embodiment of the present invention.
Figure 8B:
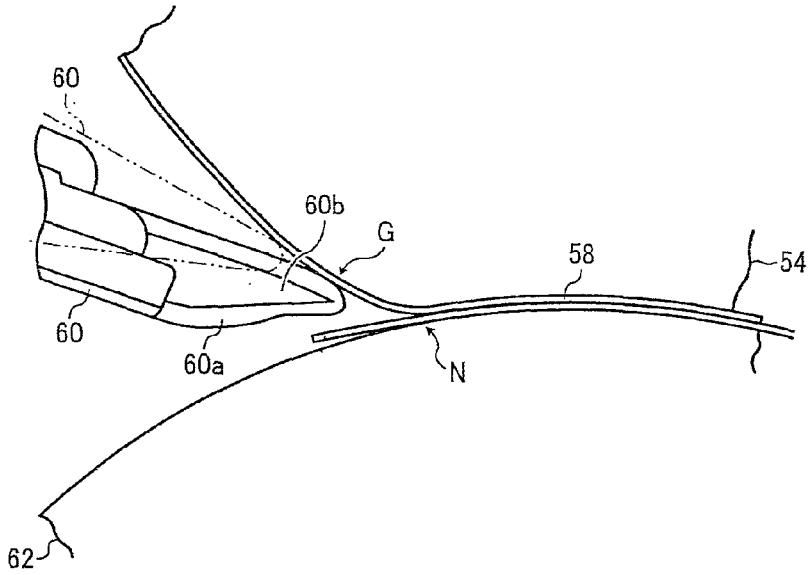
FIG. 8B is a cross-sectional view of the first sheet separator at the nip exit.

With reference to FIGS. 8A and 8B, a description is provided of the first sheet separator 60. FIG. 8A is a schematic perspective view of the first sheet separator 60. FIG. 8B is a cross-sectional view of the first sheet separator 60 at the nip exit.

As illustrated in FIG. 8A, the first sheet separator 60 includes a contact member 60*a* and a plurality of separation plates 60*b*. The contact member 60*a* is disposed at both lateral end portions of the first sheet separator 60, to contact the fixing roller 54 outside the recording medium passing area. The plurality of separation plates 60*b* is disposed along the first sheet separator 60 within the recording medium passing area of the fixing roller 54 in the axial direction thereof and spaced apart a certain distance from the fixing roller 54, to separate the recording medium from the fixing roller 54 without contacting the fixing roller 54.

As illustrated in FIG. 8B, the relative positions of a nip exit N and a contact point G, at which the tip of the contact member 60*a* of the first sheet separator 60 comes into contact with the fixing roller 54 outside the recording medium passing area, do not change because the first sheet separator 60 moves in conjunction with the pressing roller 62. Furthermore, a certain space is reliably maintained between the plurality of the separation plates 60*b* of the first sheet separator 60 and the fixing roller 54, thereby enabling separation of the recording medium from the fixing roller 54 without contacting the fixing roller 54.

Figure 9:
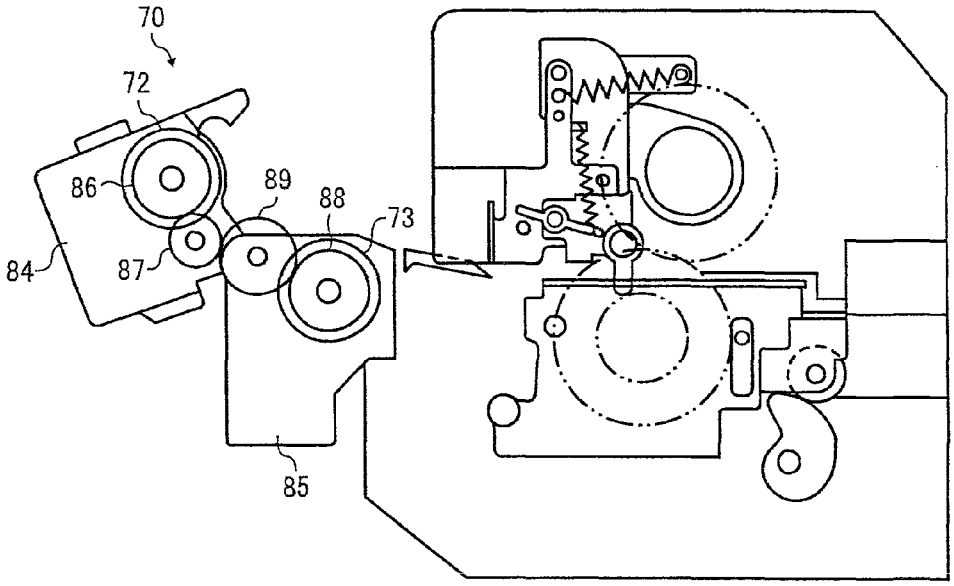
FIG. 9 is a schematic diagram illustrating an upper unit of a second fixing station employed in the image forming apparatus, when the upper unit is opened.

With reference to FIG. 9, a description is provided of the second fixing station 70. FIG. 9 is a schematic diagram illustrating an upper unit 84 of the second fixing station 70 with the upper unit 84 being opened. As illustrated in FIG. 9, the second fixing station 70 includes the upper unit 84 and a lower unit 85. The upper unit 84 includes the second fixing roller 72, a driven gear 86, and a drive gear 87. The driven gear 86 rotates in sync with rotation of the second fixing roller 72. The drive gear 87 engages the driven gear 86. The drive gear 87 is driven by a drive source, not shown.

The lower unit 85 includes the second pressing roller 73, a gear 88, a drive gear 87, and an idler gear 89. The gear 88 rotates in sync with rotation of the second pressing roller 73. The idler gear 89 engages the drive gear 87 and the gear 88.

The upper unit 84 is hinged about a rotary shaft of the idler gear 89 relative to the lower unit 85.

Generally, the space between the first fixing station 20 and the second fixing station 70 is relatively small in a fixing device that employs two fixing stations, with the result that when a paper jam occurs, it is difficult to access the jam. Accordingly, according to the present illustrative embodiment, the upper unit 84 is hinged and can rotate upward, exposing a sheet conveyance path between the first fixing station 20 and the second fixing station 70, thereby allowing easy access to the paper jam and thus facilitating removal of the jammed paper.

Figure 10:
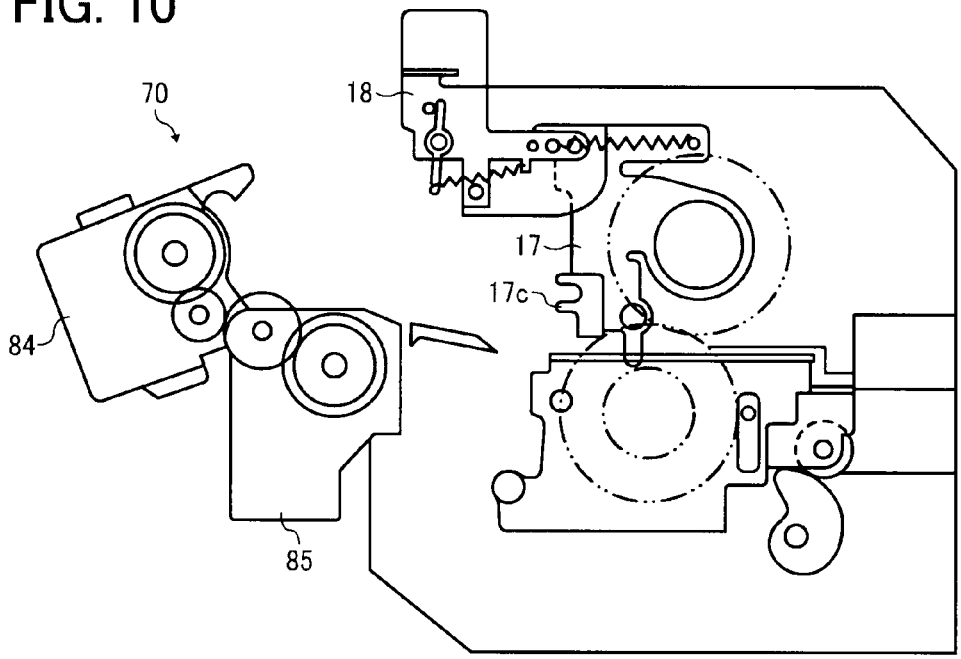
FIG. 10 is a schematic diagram illustrating the sub-bracket rotatably moved upward.
Figure 11:
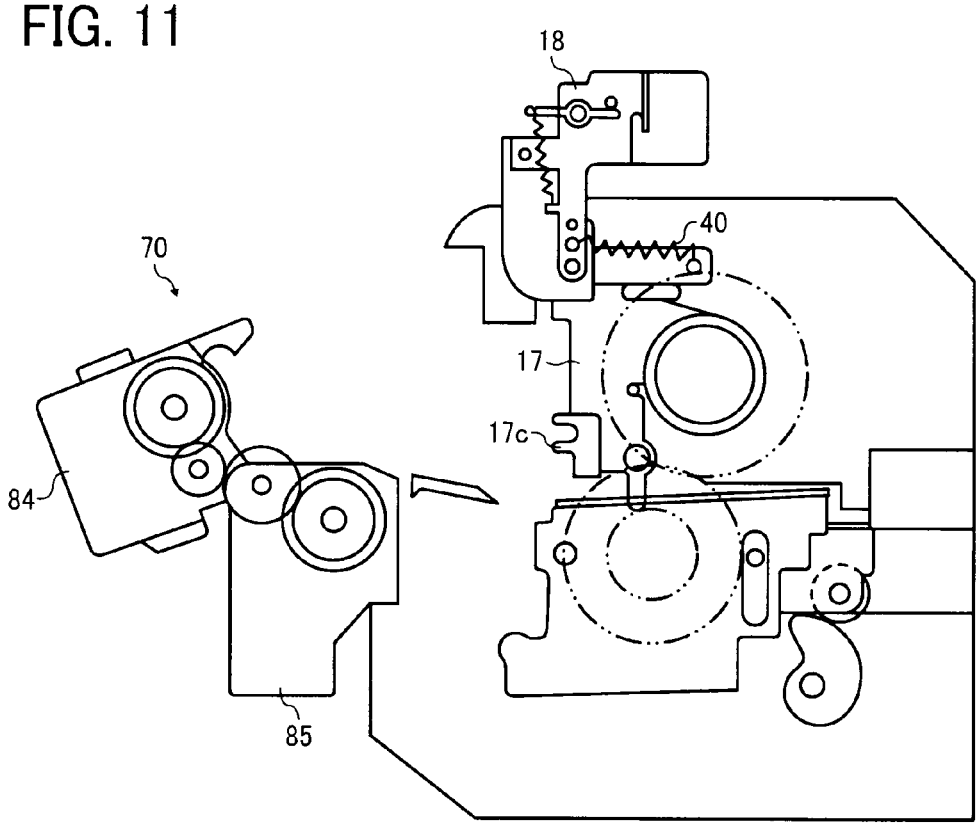
FIG. 11 is a schematic diagram illustrating the sub-bracket rotatably moved further up from FIG. 10.

With reference to FIGS. 10 and 11, a description is provided of how to access the jam. FIG. 10 is a schematic diagram illustrating the sub-bracket 18 rotatably moved upward. FIG. 11 is a schematic diagram illustrating the sub-bracket 18 rotatably moved further up from the state shown in FIG. 10.

The sub-bracket 18 is rotated upward while the upper unit 84 of the second fixing station 70 is opened. FIG. 10 illustrates the sub-bracket 18 rotating upward. As the sub-bracket 18 rotates upward, the rotary shaft 36 of the first sheet separator 60 disengages from the groove 17*c*, and one end of the lever 37 comes into contact with the regulation pin 18*e*. As the sub-bracket 18 is rotated further up as illustrated in FIG. 11, the sub-bracket 18 contacts a stopper, not illustrated, so that the upper limit position of the sub-bracket 18 is regulated as illustrated in FIG. 11, and the position of the sub-bracket 18 is maintained by the spring 40.

With this configuration, the sub-bracket 18 can be opened, allowing easy access to the place where the paper jam occurred, thereby facilitating removal of the jammed paper.

It should be noted that although in the foregoing description the second fixing station functions as a gloss finishing unit, the function of the second fixing station is not limited thereto. Thus, for example, the second fixing station may simply re-fix a toner image that the first fixing station failed to fix properly and well.

Referring back to FIG. 3, a description is provided of the pressing lever assembly 35 in detail. As illustrated in FIG. 3, the pressing lever assembly 35 includes the internal lever 78 and the external lever 79.

The internal lever 78 includes a bearing 81 serving as a roller that contacts the circumferential surface (cam surface) of the cam 77. The cam 77 has a shape that allows the cam surface to rise gradually as the cam 77 rotates in the direction indicated by an arrow in FIG. 3. Rotation of the cam 77 adjusts an extent of engagement of the pressure roller 62 against the fixing roller 54 through the fixing belt 58 and a width of the nip portion steplessly.

Figure 12:
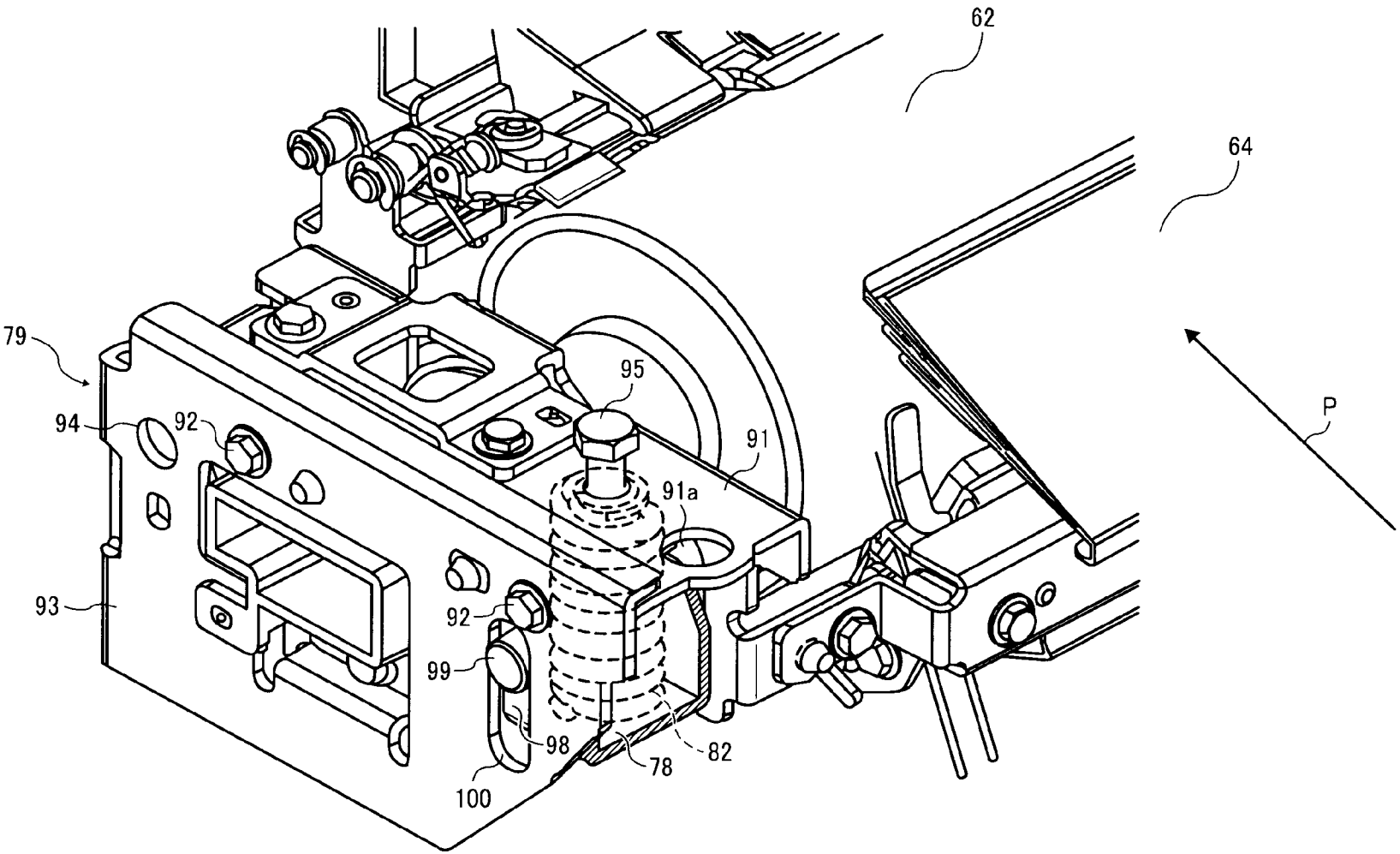
FIG. 12 is a schematic perspective view of a rotation mechanism of a pressing lever assembly according to an illustrative embodiment of the present invention.

As illustrated in FIG. 12, a coil spring 82 serving as an elastic member is provided between the internal lever 78 and the external lever 79. FIG. 12 is a schematic perspective view of a rotation mechanism of the pressing lever assembly 35 serving as a positioning mechanism. The coil spring 82 acts in the direction of the pressing roller 62 pressing against the fixing roller 54 when the pressing roller 62 contacts the fixing roller 54 to press against the fixing roller 54.

As illustrated in FIG. 12, the external lever 79 includes an internal plate 91, an external plate 93, and a bolt 92. The internal plate 91 holds both lateral end portions of the fixing roller 62 through the ball bearing 34 (shown in FIG. 3). The external plate 93 is fixed to the internal plate 91 by the bolt 92. Both the internal plate 91 and the external plate 93 include a through-hole 94 through which the shaft 75 is inserted.

A bolt 95 is threaded through the upper surface of the internal plate 91 of the external lever 79 into the coil spring 82 to support the coil spring 82. The bolt 95 serves as a shaft to support the coil spring 82 and also serves as a stopper to regulate the upper limit position of the external lever 79. It is to be noted that the internal lever 78 is only partially illustrated in FIG. 12.

Figure 13:
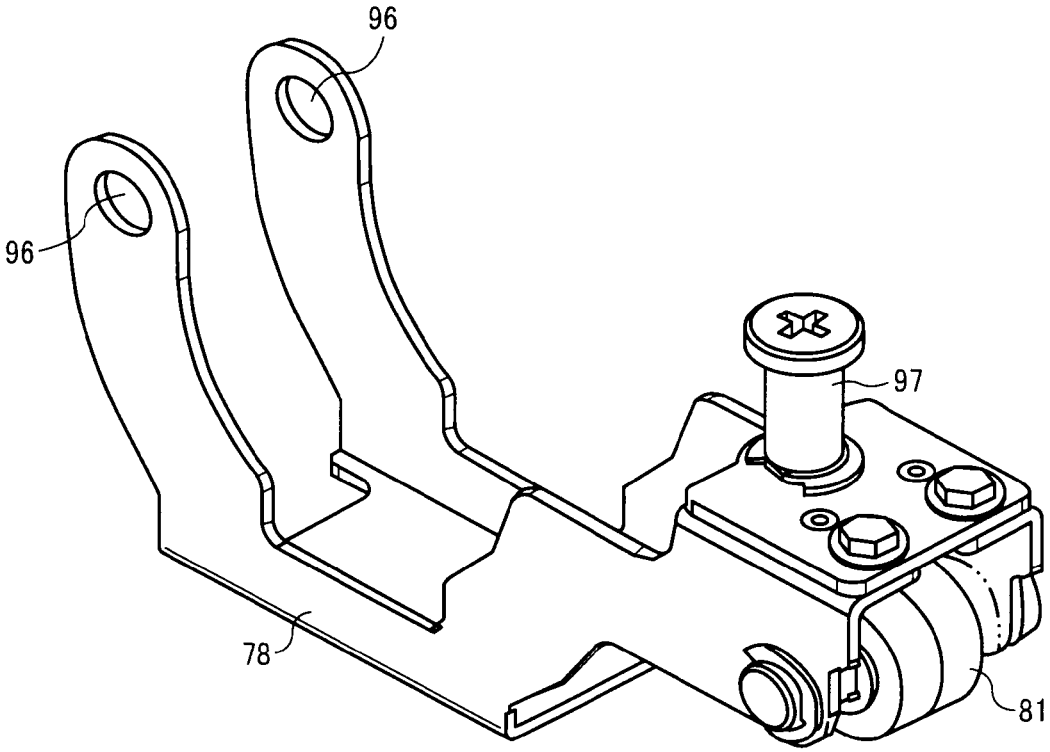
FIG. 13 is an external view of an internal lever of the pressing lever assembly of FIG. 12 according to an illustrative embodiment of the present invention.

With reference to FIG. 13, a description is provided of the internal lever 78. FIG. 13 is an external view of the internal lever 78. The internal lever 78 includes through-holes 96 through which the shaft 75 is inserted, similar to the external lever 79. The internal lever 78 and the external lever 79 are connected by a screw shaft 97 inserted into a hole 91*a* (shown in FIG. 12) formed in the upper surface of the internal plate 91. The internal lever 78 and the external lever 79 are connected with a certain clearance.

Figure 14:
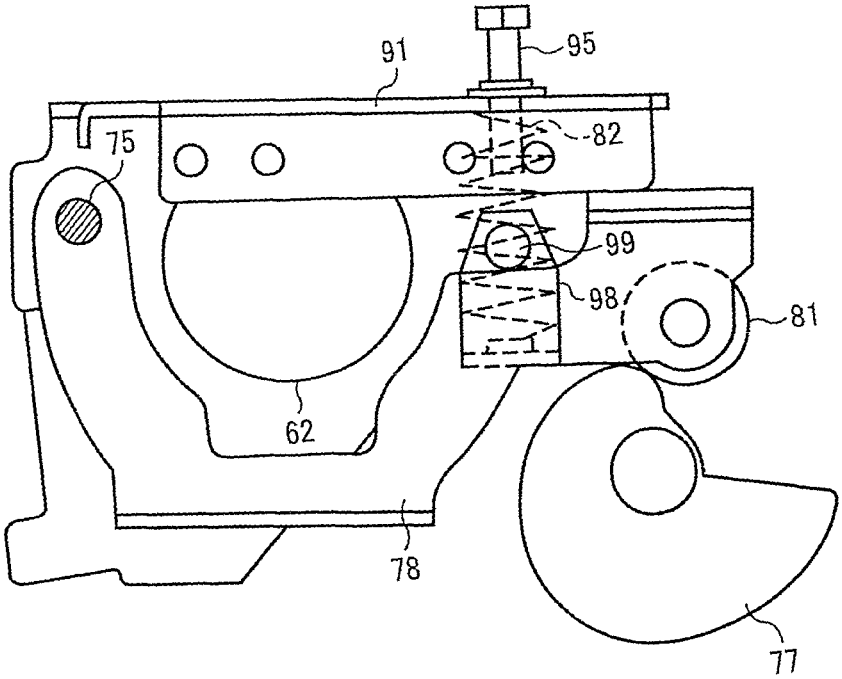
FIG. 14 is a schematic diagram illustrating a biasing mechanism using an external lever and the internal lever of the pressing lever assembly.

As illustrated in FIG. 14, a spring washer 98 for the coil spring 82 is fixed inside the internal lever 78. FIG. 14 is a schematic diagram illustrating a biasing mechanism using the external lever 79 and the internal lever 78. A shaft pin 99 is fixed to the spring washer 98 such that the shaft pin 99 projects horizontally outside. The shaft pin 99 engages a slot 100 (shown in FIG. 12) formed in the external plate 93 of the external lever 79. With this configuration, a degree of shift of the internal lever 78 and the external lever 79 due to a change of the position of the pressing roller 62 is regulated. As illustrated in FIG. 14, the coil spring 82 is disposed between the spring washer 98 and the upper surface of the internal plate 91.

The internal lever 78 is directly and rotatably driven by the cam 77. In other words, the cam 77 changes the lowest end position of the coil spring 82.

When the cam 77 is rotated in the clockwise direction as described above, the pressing lever assembly 35 rotates upward, causing the pressing roller 62 to pressingly contact the fixing roller 54 through the fixing belt 58. After the pressing roller 62 pressingly contacts the fixing roller 54, the coil spring 82 is compressed, thereby reliably pressing the pressing roller 62 toward the fixing roller 54. Without the coil spring 82, there is no allowance in positioning of the pressing roller 62 when changing the position of the pressing roller 62. That is, the spring force of the coil spring 82 enables the pressing condition of the pressing roller 62 to change reliably between the first pressing state, the second pressing state, and so forth. The pressing roller 62 is biased (pressed) by the upper end of the coil spring 82.

According to the illustrative embodiments, the pressing position of the pressing roller 62 is changed in multiple steps, for example, the first pressing state suitable for fixing, for example, a relatively thin sheet, a no-coating sheet, and the like, and a second pressing state suitable for fixing, for example, a relatively thick sheet, a coated sheet, and the like. Alternatively, the pressing positions are not limited to two, that is, the first pressing state and the second pressing state, and the number of pressing positions may be increased by employing a stepless cam as the cam 77. In such a case, a data table for sheet types and proper pressing positions corresponding to the recording media sheets may be stored in a memory of the controller, and the proper pressing position may be selected in accordance with the types of the recording medium. An amount of rotation of the cam 77 to move the pressing roller 62 to a proper pressing position is obtained by adjusting the number of steps of the stepping motor serving as the drive source of the cam 77, for example.

As described above, the image forming apparatus using the fixing device according to the illustrative embodiments can accommodate various types and thicknesses of recording media sheets without hindering separation of the recording media sheets from the fixing roller and the pressing roller after fixing operation.

Furthermore, the image forming apparatus according to the illustrative embodiments is capable of applying gloss finish and provides an easy access to the paper jam without degrading separability of the fixing device.

According to the foregoing embodiments, the present invention is employed in the belt-type fixing device. However, the present invention may be employed in a heat-roller type fixing device and a device that conveys a sheet and supplies heat thereto.

According to the illustrative embodiment, the present invention is employed in an image forming apparatus. The image forming apparatus includes, but is not limited to, a copier, a printer, a facsimile machine, and a multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. A fixing device for fixing a toner image on a recording medium, comprising:

a first fixing station including a fixing roller to rotate about a shaft in a predetermined direction of rotation;

a pressing roller disposed opposite the fixing roller to rotate and contact an outer circumferential surface of the fixing roller to form a nip between the pressing roller and the fixing roller through which the recording medium bearing the toner image passes to fix the toner image with heat and pressure, a position of the pressing roller changeable relative to the fixing roller;

a positioning mechanism operatively connected to the pressing roller to change the position of the pressing roller;

a sheet separator disposed downstream from the nip to move in conjunction with movement of the pressing roller to separate the recording medium from the fixing roller without changing position relative to the fixing roller; and a bracket disposed rotatable about the shaft of the fixing roller, to hold the sheet separator, a portion of the bracket contacting a portion of the positioning mechanism to be positioned in place.

2. The fixing device according to claim 1, further comprising a sub-bracket rotatably provided to the bracket, to rotatably hold the sheet separator.

3. The fixing device according to claim 2, wherein the sheet separator rotates about a rotary shaft from which the sheet separator is biased towards the fixing roller, the sub-bracket includes a hole having a diameter greater than the rotary shaft, to hold the rotary shaft of the sheet separator, and the bracket includes a groove, and the rotary shaft of the sheet separator fits the groove to be positioned in place upon installation of the sub-bracket in the bracket.

4. The fixing device according to claim 3, wherein the sheet separator includes:

a contact member projecting from a lateral end portion of the sheet separator toward the fixing roller, to contact the fixing roller outside a recording medium passing area of the fixing roller over which the recording medium passes; and a plurality of separation plates disposed in the axial direction of the fixing roller inboard of the contact member and within the recording medium passing area and spaced apart a predetermined distance from the fixing roller.

5. The fixing device according to claim 1, further comprising a second fixing station disposed downstream from the nip exit of the first fixing station, to apply a gloss finish to the fixed toner image, the second fixing station including a fixing roller to rotate about a shaft in a predetermined direction of rotation; and a pressing roller disposed opposite and axially parallel to the fixing roller to rotate and contact an outer circumferential surface of the fixing roller to form a nip between the pressing roller and the fixing roller, through which the recording medium bearing the fixed toner image passes to apply gloss finish on the fixed toner image using heat.

6. The fixing device according to claim 1, further comprising a second fixing station disposed downstream from the nip of the first fixing station, the second fixing station including an upper unit including a fixing roller that rotates about a shaft in a predetermined direction of rotation;

a lower unit including a pressing roller disposed opposite and axially parallel to the fixing roller that rotates and contacts an outer circumferential surface of the fixing roller to form a nip between the pressing roller and the fixing roller through which the recording medium bearing the fixed toner image passes, and an idler gear disposed rotatable about a shaft, to transmit a driving force to the pressing roller to drive the pressing roller, wherein the upper unit is rotatable about the shaft of the idler gear, away from the lower unit.

7. The fixing device according to claim 6, wherein the second fixing station applies a gloss finish to the fixed toner image on the recording medium in the nip.

8. An image forming apparatus, comprising the fixing device according to claim 1.

* * * * *